US009111656B2

(12) United States Patent
Schmidt et al.

(10) Patent No.: US 9,111,656 B2
(45) Date of Patent: Aug. 18, 2015

(54) RADIATION BEAM COLLIMATION SYSTEM AND METHOD

(71) Applicants: Oliver A. Schmidt, Lombard, IL (US); Mohan Ramanathan, Naperville, IL (US)

(72) Inventors: Oliver A. Schmidt, Lombard, IL (US); Mohan Ramanathan, Naperville, IL (US)

(73) Assignee: UCHICAGO ARGONNE, LLC, Chicago, IL (US)

( * ) Notice: Subject to any disclaimer, the term of this patent is extended or adjusted under 35 U.S.C. 154(b) by 0 days.

(21) Appl. No.: 13/972,440

(22) Filed: Aug. 21, 2013

(65) Prior Publication Data

US 2015/0055759 A1 Feb. 26, 2015

(51) Int. Cl.
*G21K 1/02* (2006.01)
*G21K 1/04* (2006.01)

(52) U.S. Cl.
CPC ..... *G21K 1/04* (2013.01)

(58) Field of Classification Search
CPC ..... G21K 1/02; G21K 1/04; G21K 1/046; G21K 1/043; A61B 6/06; A61N 5/10
USPC ..... 378/147, 149, 150; 250/505.1
See application file for complete search history.

(56) References Cited

U.S. PATENT DOCUMENTS

| | | | | |
|---|---|---|---|---|
| 4,035,522 | A | 7/1977 | Hatzakis | |
| 5,081,659 | A | 1/1992 | Dobbins, III | |
| 7,440,546 | B2 | 10/2008 | Liu et al. | |
| 8,017,926 | B2 * | 9/2011 | Norman et al. | 250/505.1 |
| 2011/0268247 | A1 * | 11/2011 | Shedlock et al. | 378/62 |

* cited by examiner

*Primary Examiner* — Jurie Yun
(74) *Attorney, Agent, or Firm* — Cherskov Flaynik & Gurda, LLC

(57) ABSTRACT

The invention provides a method for collimating a radiation beam, the method comprising subjecting the beam to a collimator that yaws and pitches, either separately or simultaneously relative to the incident angle of the beam. Also provided is a system for collimating radiation beams, the system comprising a collimator body, and a stage for pitching and yawing the body. A feature of the invention is that a single, compact mask body defines one or a plurality of collimators having no moving surfaces relative to each other, whereby the entire mask body is moved about a point in space to provide various collimator opening dimensions to oncoming radiation beams.

18 Claims, 6 Drawing Sheets

VARIABLE APERTURE MASK/SLITS
APERTURE SIZE vs. ANGLE 12
18
20

3.0°
2.5°
2.0°
1.5°
1.0°
0.5°
0°

0°
0.5°
1.0°
1.5°
2.0°
2.5°

FIG 4B SECTION B-B

SECTION C-C

RADIATION BEAM COLLIMATION SYSTEM AND METHOD

The United States Government has rights to this invention pursuant to Contract No. DE-AC02-06CH11357 between the United States Government and UChicago Argonne, LLC representing Argonne National Laboratory.

BACKGROUND OF THE INVENTION

1. Field of the Invention

The present invention relates to the field of radiation beam focusing and, more specifically, an embodiment of the present invention relates to a method and a system for the two-dimensional collimation of an x-ray beam.

2. Background of the Invention.

Accelerator-produced high-energy x-ray beams often must be collimated to produce a narrow beam having parallel planar boundaries.

In most situations, a large fraction of the beam incident on the collimator must be blocked by the collimator. This results in large amounts of heat being deposited in the collimator which requires a means to carry heat away from the collimator.

Sometimes it is necessary to install separate collimators with plates that narrow a beam (initially traveling, say, in the z direction) first in the x direction and then in the y direction (or in any two orthogonal directions) so as to allow adjustment of the separation between the plates. This sequential arrangement requires the sacrifice of valuable space in the experimental area, space that can otherwise be populated by instruments and components to enhance research.

Slits are widely used throughout the Advanced Photon Source beam lines at Argonne National Laboratory (Argonne, Ill.), and other x-ray facilities around the world, to both define the size of the x-ray beam and to vary the overall heat load on downstream optical components. White beam slits in particular, require cooled beam absorbing surfaces, to intercept the beam at some incident angle determined by the beam profile. As this angle gets smaller, the mask must get longer to maintain the same effective inlet aperture. There are many different designs in operation and in most cases, a single x-ray beam requires the opposing horizontal and vertical edges of two separate mask bodies to define it.

A typical beamline has one or two undulators installed inline at the straight section between bending magnets in the accelerator storage ring. A canted undulator beamline uses additional magnets to cant the electrons 5 mrad outboard through the first undulator, then inboard 1 mrad through the second undulator which creates two independent beams 1 mrad apart. A third corrector magnet steers the electrons back into the storage ring.

To define the beam in both the horizontal and vertical, an L-type design is typically employed. These slits are basically comprised of a pair of movable masks, in line with the beam, that work together. Each mask will define one horizontal and one vertical beam edge. In many cases, these mask bodies are identical, with one flipped upside down in relation to the other to define opposing edges.

The problem with this traditional design is that each beam requires two masks separated by a bellows to allow for independent motion. In the case of a canted undulator beamline, the independent manipulation of both beams would require four separate masks which would eat up a large portion of valuable beamline real estate.

A need exists in the art for a method and a system for independently varying each beam of a multi radiation beam line. For example, in a dual beam line geometry, the method and system should allow for varying the size of one electron beam while allowing the second beam to pass through unaffected. The method and system should be compact compared to traditional designs. Also, the method and system should involve no moving slits relative to each other so as to minimize maintenance and alignment issues.

SUMMARY OF INVENTION

An object of the invention is to introduce a rapid and adjustable slit/collimation system for radiation (x-rays, electrons, protons, neutrons) beams that overcomes many of the disadvantages of the prior art.

Another object of the invention is to provide a device for facilitating two-dimensional collimation along the same segment of a radiation beam. A feature of this invention is the use of collimators (orthogonally and immovably positioned relative to each other) and both positioned along an axis for the system (e.g., the z axis) intended to coincide with the incident radiation beam, with each collimator defining two elongated surfaces generally at some incident angle to the z axis. An advantage of this invention is very compact collimation of a radiation beam.

Another object of the invention is to facilitate adjustable two-dimensional collimation on the same segment of a radiation beam. A feature of this invention is an isosceles trapezoidal cross-section for each of the collimator apertures (which are immovable relative to each other) in a plane perpendicular to the z axis (with said isosceles trapezoid cross sections dimensioned so as to allow simultaneous positioning of the apertures in directions parallel and perpendicular to said z axis as well as rotation about an axis perpendicular to the z axis. An advantage of this invention is that the simultaneous positioning of the orientation of the apertures relative to the incident beam allows for two-dimensional adjustment of the collimation of the beam.

Yet another object of the invention is to facilitate rapid two-dimensional collimation along the same segment of a radiation beam. A feature of this invention is the use of two orthogonal collimators, with each collimator defining passageways parallel to the z axis, with means to simultaneously impart to each passageway rectilinear motion along the z axis and along a first direction perpendicular to the z axis as well as rotational motion around a second direction perpendicular to said z axis and to the first direction; and finally with means to impart to the juxtaposed collimators rotational motion around the x and y axes. An advantage of this invention is the ability to control rapidly and remotely the collimation of a radiation beam without physically modifying the size, absolute dimensions, or shapes of the collimator's apertures, surfaces or passageways.

Still another object of the present invention is to provide a method for collimating beam lines that requires no physical modification of collimator apertures, channels or slit widths. A feature of the invention is that a monolith defining a collimator is positioned relative to incoming radiation beams to allow the collimator to open and close symmetrically about the x-ray beam. An advantage of the invention is that no moving parts are associated with the collimator; rather, the collimators is static and integrally molded with the monolith so as to afford a compact collimator. Rather, the whole monolith is moved to provide variable collimation.

In brief, the invention provides a method for collimating a radiation beam, the method comprising subjecting the beam to a collimator aperture that has no moving parts. An embodiment of the method subjects the beam to a collimator that yaws (i.e., moves side to side), and pitches (i.e., tilts up and down), or both simultaneously, relative to the incident angle of the beam. The pitching axis and the yawing axis rotate about each other at their intersection point.

Also provided is a system for collimating radiation beams, the system comprising a collimator body, and a stage for pitching the body (i.e. moving the body along an arc through a horizontal plane), yawing the body (i.e., moving the body along an arc through a vertical plane) and simultaneously pitching and yawing the body. The pitching axis and the yawing axis rotate about each other at their intersection point. The invention further provides a system for collimating a medium, the system comprising a collimator body; and a collimator body support surface for pitching or yawing or pitching and yawing the body.

BRIEF DESCRIPTION OF DRAWING

The invention together with the above and other objects and advantages will be best understood from the following detailed description of the preferred embodiment of the invention shown in the accompanying figures, wherein:

FIGS. 4A-C depict various views of a multiport collimator monolith, in accordance with features of the present invention;

DETAILED DESCRIPTION OF THE INVENTION

The foregoing summary, as well as the following detailed description of certain embodiments of the present invention, will be better understood when read in conjunction with the appended drawings.

As used herein, an element or step recited in the singular and preceded with the word "a" or "an" should be understood as not excluding plural said elements or steps, unless such exclusion is explicitly stated. Furthermore, references to "one embodiment" of the present invention are not intended to be interpreted as excluding the existence of additional embodiments that also incorporate the recited features. Moreover, unless explicitly stated to the contrary, embodiments "comprising" or "having" an element or a plurality of elements having a particular property may include additional such elements not having that property.

The present invention provides a dynamic x-ray slit/collimator system enabling two-directional positioning x-ray beam collimation using a plurality of collimators statically arranged relative to each other and to the incoming radiation beam. The collimators may or may not be simultaneously manipulated relative to each other in relation to an incident radiation beam. In an embodiment of the invention, a single mask body provides all of the necessary motion for collimation of a single x-ray beam. In another embodiment of the invention, a two collimator system has been developed to use in canted undulator beamlines, whereby one beam is collimated and another, passing through the same mask body, is not collimated. Rather, that second beam is collimated by a second mask body arranged "downstream" of the first mask body or monolith, if necessary.

Figure 1:
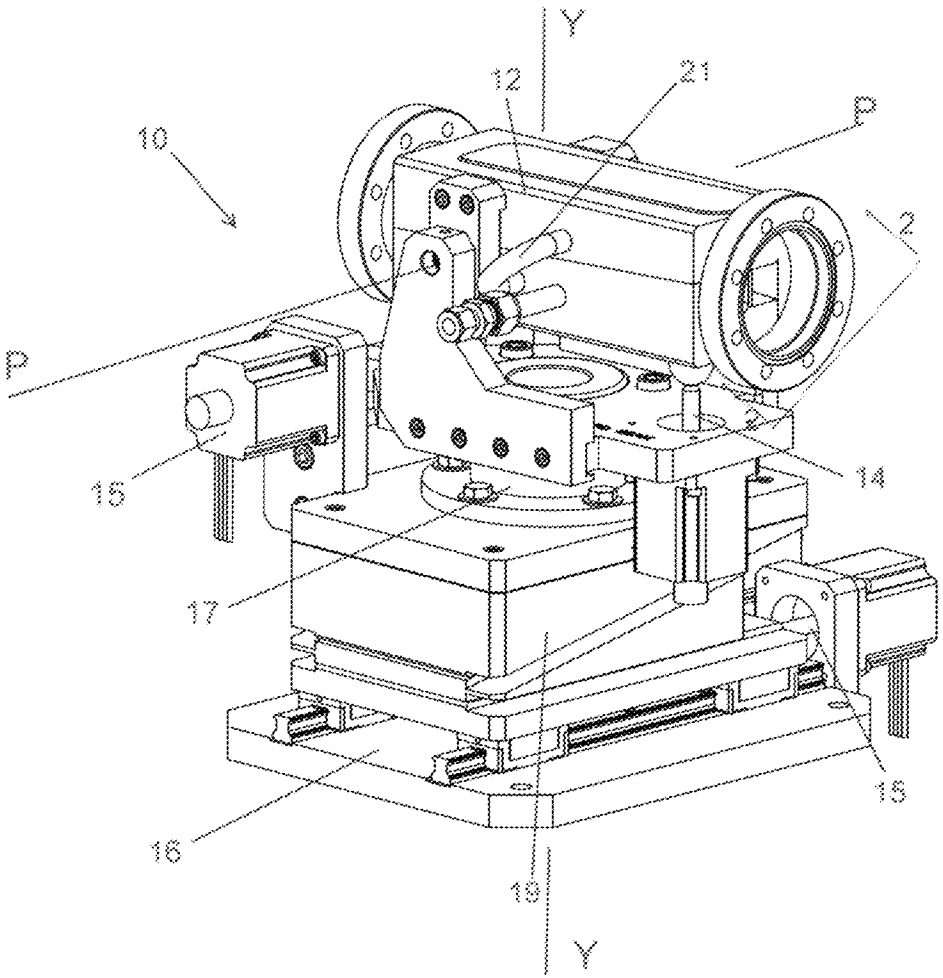
FIG. 1 is a perspective view of a collimator monolith supported by a tilting as well as a horizontal and vertical positioning stage, in accordance with features of the present invention.

A collimator slit is defined by an aperture extending through the monolith thereby forming a tunnel through the monolith. As such, the tunnel has a first upstream end and a second downstream end. The upstream end itself is defined by usually four edges at orthogonal angles to each other. Each of the edges are termination points for surfaces that extend relatively parallel to the axis of the beam line. The edges and therefore the surfaces are positioned relative to the beam line by first being frozen in space relative to each other such that the surfaces are integrally molded or affixed to the same monolith or bulk heat sink structure. Two opposing surfaces collimate an incoming beam in the x-direction and two opposing surfaces collimate the beam in the y-direction. The collimation system works by simultaneously pivoting both pairs of edges on an axis centered between internal opposing edges in both the horizontal (P axis as shown in FIG. 1 and vertical planes (Y axis). Inasmuch as the pivot point (defined as the intersection of the pitch axis P and the yaw axis Y) is centered, the slit opens and closes symmetrically about the radiation beam. Depending on how the monolith is moved, the x-axis collimation edges/surfaces can change relative to the incoming beam while the y-axis collimator remains unchanged, and vice versa.

A relief cut along the length of all four adjacent surfaces of each of the slits provides thermal stress relief. An additional feature is that the horizontal and vertical edges of each of the substrates forming the surfaces of each of the collimator passageways are staggered. This results in the beam cavity defining sharp corners, sans the rounded corners associated with even the most accurate of machining techniques. (Rounded corners are unavoidable if both the horizontal and adjacent vertical edge were in the same plane because of some minimum machinable radius. The disadvantage to this is that there would be a stress concentration at the corner.)

Linear actuators acting as a lever arm at a fixed distance from the center of rotation, provide precise control of the aperture. Resolution is around 13 μm, depending on the specific motor. One mask body can thereby define all four edges of the x-ray beam, taking up half the space of conventional slits.

Collimator Monolith

Detail

FIG. 1 illustrates an embodiment of the collimator system, the system designated generally as numeral 10. A monolith 12 defines a plurality of collimator passages, the monolith positioned in its entirety by vertical actuators 14 and horizontal actuators 15 in electrical and physical communication with a stage 16. The stage 16 is remotely controlled by the operator. The bottom stage 16 is for horizontal scanning of the x-ray beam and is not part of the tilting mechanism. A means for raising or lowering the entire monolith, such as a vertical scanning stage 19 further optimizes monolith positioning capabilities.

Figures 2A, 2B, 2C, 2D:
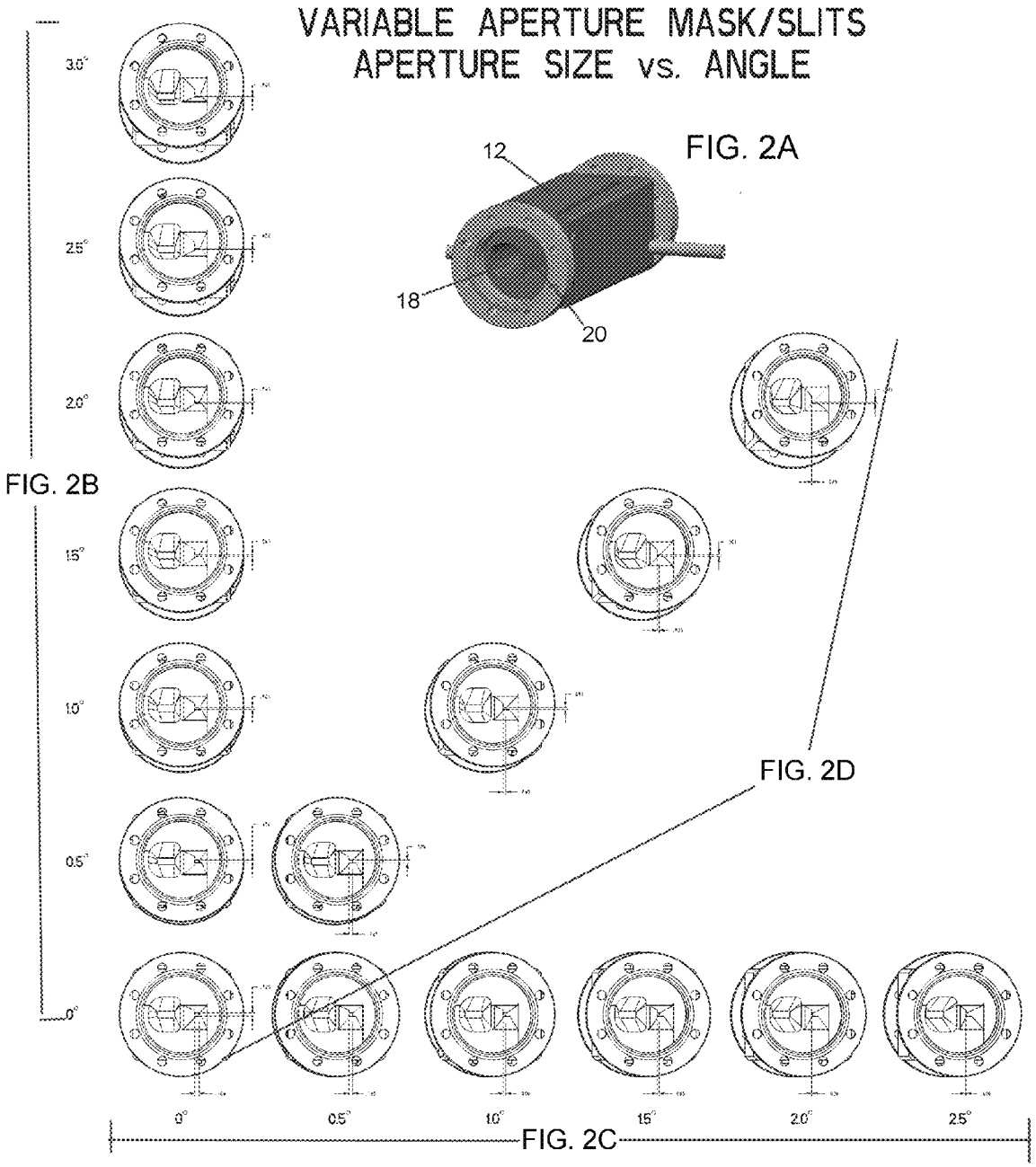
FIG. 2A is a cross section along line 2-2 of FIG. 1 of an adjustable two dimensional slit/collimation system for a radiation beam, in accordance with features of the present invention.
FIGS. 2B-D depict various positions of the collimator as affected by its support stage, in accordance with features of the present invention.

FIG. 2A, which is a view taken along line 2-2 in FIG. 1, depicts a front end view of the monolith 12 defining a feed through port 18 for a beam, and a collimator 20. Both the feed-through port and the collimator are integrally molded with the monolith. FIG. 2B depicts the front end of the monolith wherein the front end is shown pitched upwardly from the horizontal from 0 degrees in the bottom view to 3 degrees in the top view of FIG. 2B. As noted supra, the feed through port 18 is adapted to allow a beam to pass through the monolith unscathed. A second monolith, located upstream or downstream of the first monolith is installed upside down relative to the first monolith and co-linear with the first monolith so as to collimate the beam not affected by the first monolith.

FIG. 2C depicts the front end of the monolith wherein the front end is shown yawing to the right, starting on the left side of FIG. 2C., from 0 degrees to 2.5 degrees. FIG. 2D depicts the front end of the monolith both pitching upwardly and yawing to the right. FIGS. 2B-D illustrate that while widths of each of the apertures 18, 20 vary with the positioning of the entire monolith, no moving parts are otherwise associated varying the slit geometry of the collimator 20.

As the collimator 20 opens and closes, the incident strike angle changes, which greatly affects the thermal loading of the component. The angular travel from fully open to fully closed is 3 degrees. The angle of one opposing surface increases as the other decreases in both the horizontal and vertical directions. In the open position, the opposing surfaces are at 2° and 5° to the x-ray beam. As the slit closes, these angles invert to 5° and 2° respectively.

Another feature of the system is isolating and manipulating each beam independent of the other. Canted undulator slits were designed to reside in a typical APS canted beamline immediately after the front end exit table in the first optical enclosure. As noted supra a second adjacent aperture molded with the monolith is a pass through aperture 18 and allows the other canted beam to pass through unaffected. Since the canted beams diverge by 1 mrad, the distance between the two apertures is designed to allow the second beam to pass unaffected when installed in a range of about 27 to about 28 meters from the source (where the beams are separated by about 27 to about 28 mm due to the 1 mrad divergence). This beam bypass 18 is also tapered in such a way that as the monolith 12 is rotated about the vertical (y-axis) and horizontal (x-axis) plane, the overall size of the bypass aperture 18 is virtually unaffected. The taper of the bypass channel assures that its sides do not pass into the line of travel of the beam.

Another consideration is that while the slit is rotating, the edge of the inlet aperture moves closer to the incoming beam at which point the component would see normal incidence and the material may fail. As such, the taper of the by-pass port 18 assures that its sides do not pass into the beam, therefore preventing the sides from overheating and failing. This problem is compounded when the slit is used for scanning. Hence, the geometry of the slits is optimized to allow for +/−3 mm of travel in both H and V with the slits fully closed (or at a minimum aperture size suitable for scanning across the beam profile.) So, with the bypass port 18 and collimator slit 20 fully closed, there is still approximately +/−3 mm of space before the x-ray beam would hit the edge of the inlet aperture.

The monolith as featured defines the bypass port 18 and the collimator slit 20. As discussed supra, the bypass port is adapted to receive a second media stream such as a radiation beam for collimation downstream of the monolith. However, if only one media stream is in the offing, then the collimator need not have a bypass port 18 but rather define just a single collimator aperture 20.

An embodiment of the monolith is shown as comprising two pieces. Thermal conductivity and overall yield strength are the relevant factors in choosing materials comprising the monolith. Suitable construction materials for the monolith is metal or metal matrix composite alloys having high thermal conductivity and high strength at temperatures exceeding 1000 C. Suitable materials include, but are not limited to tungsten, copper, or copper-based metal matrix composites (MMC) such as GlidCop® (North American Hoganas, Inc., Hollsopple, Pa.), Glidcop® has a high thermal conductivity as it is mostly copper, but has a much higher yield strength. Optionally, the monolith constituents may include compounds to increase the metal's resistance to thermal softening while enhancing strengths of the metal at high temperatures. One such suitable additive is aluminum oxide ceramic.

Figure 5:
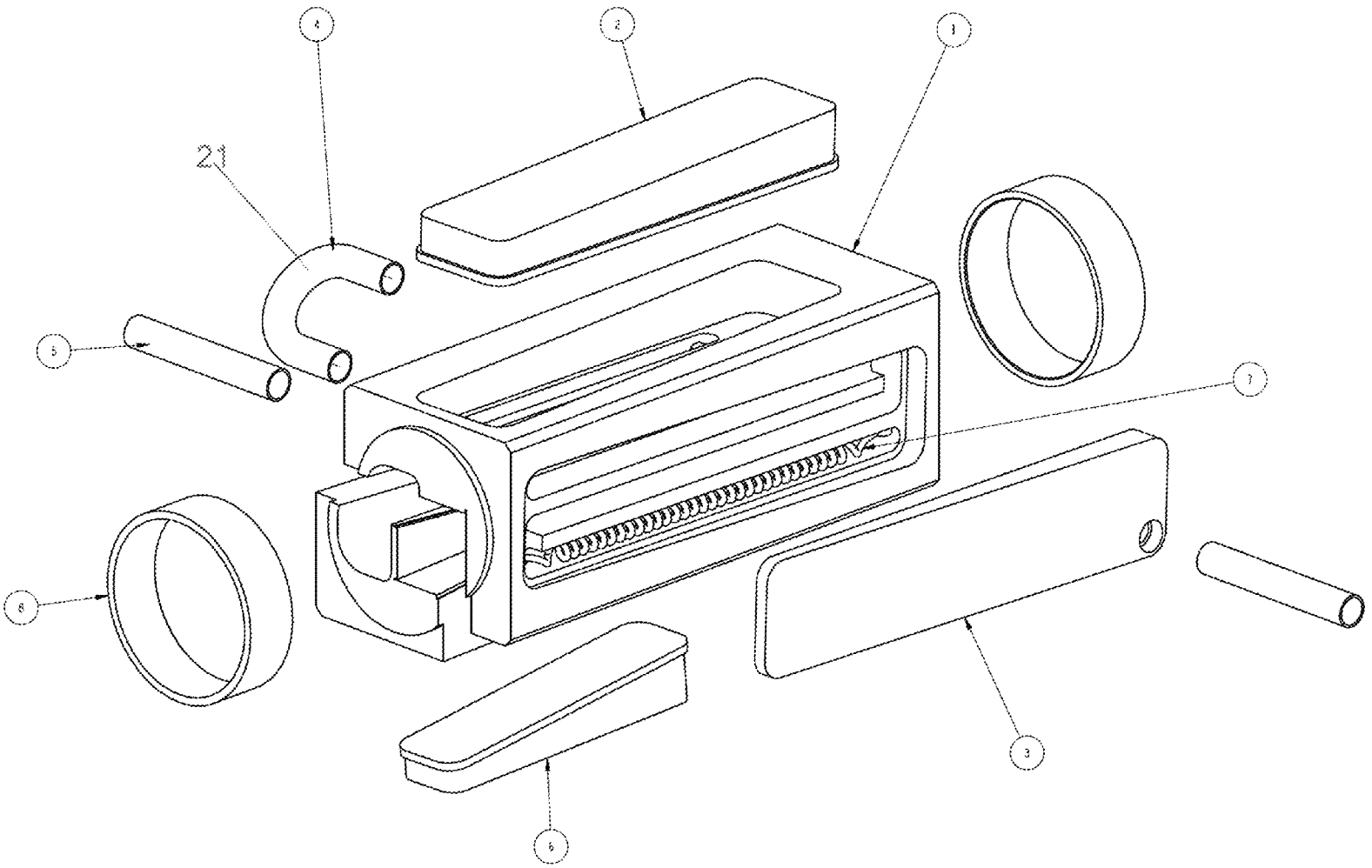
FIG. 5 is a partially exploded view of the collimator monolith, in accordance with features of the present invention.

Internal surfaces of the monolith define cooling channels. Inasmuch as it is preferred that all regions of the monolith be cooled equally, a feature of the cooling means is that the channels are linked internally between adjacent surfaces with only one external jumper 21 across the braze joint (FIG. 1, FIG. 5). FIG. 5 is an exploded view of the monolith, showing cooling channel detail, wherein the cooling channel covers 23 are removed.

Figure 3:
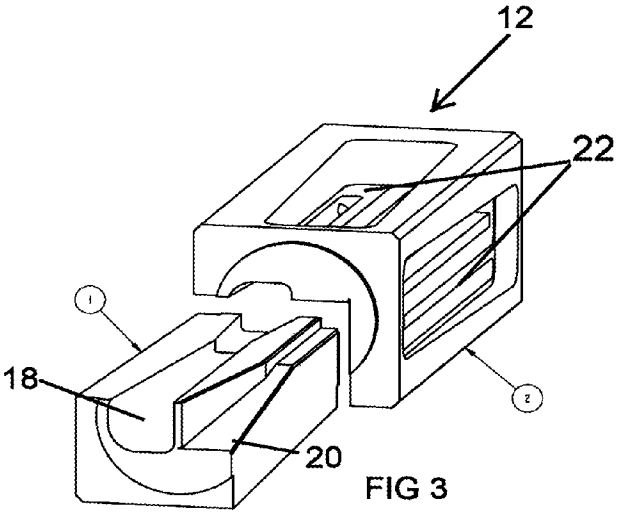
FIG. 3 is an exploded view of the collimator monolith, in accordance with features of the present invention.

FIG. 3 shows an exploded view of the monolith 12 as comprising two pieces. This view shows how the two collimator apertures 18 and 20, are formed from the combining of the two pieces comprising the monolith. The two collimators are created when the two monolith pieces are joined together, either irreversibly (such as via brazing), or reversibly (such as via a nut-bolt configuration). FIG. 3 also depicts the monolith with side panels (not shown) removed to expose cooling channels 22 designed to keep the monolith at predetermined temperatures. Preferably, the two pieces of the monolith are brazed to create a vacuum tight seal. The side panels (cooling channel covers) are brazed on but could be removably attached via nut and bolted with a gasket positioned between the panel and the peripheral borders defining the opening of the channels on the sides of the monolith.

Figure 4C:
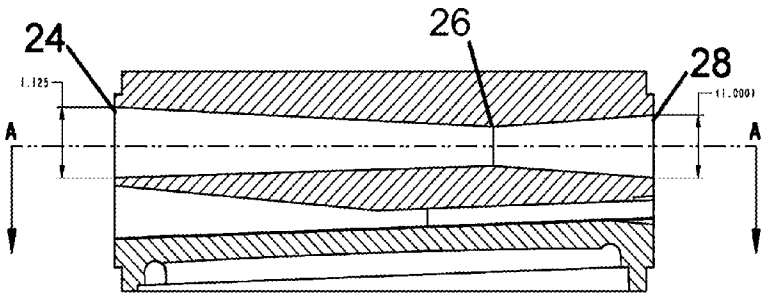
Figure 4C:
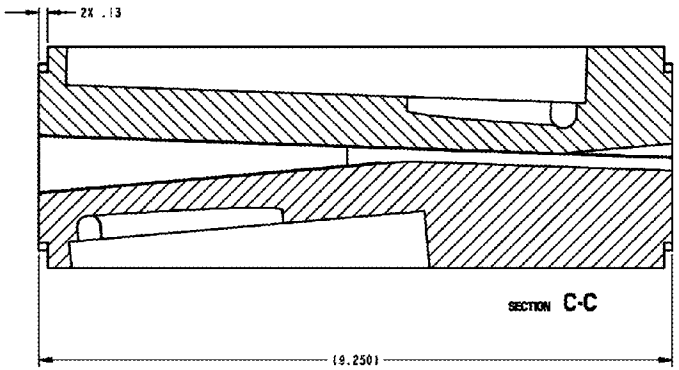
Figure 4A:
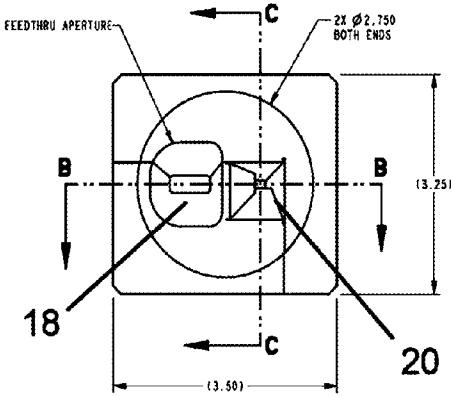

FIG. 4A shows a front end view of the monolith with the two monolith pieces joined together. FIG. 4B is a view of FIG. 4A taken along line B-B of FIG. 4A. This figure shows an embodiment of the collimator monolith whereby the pass through aperture 18 tapers medially from its beam incident opening 24 to a point 26 along its longitudinal axis at which point tapering stops and the collimator channel diverges radially. The radially diverging channel terminates at a beam exit point 28 of the pass through aperture 18. This embodiment shows the pass through aperture 18 as symmetrical along its longitudinal axis while the collimator 20 is non-symmetrical along its longitudinal axis. The longitudinal axis of the pass through aperture 18 and the collimator 20 are generally parallel to the longitudinal axis of the monolith.

FIG. 4C is a view of FIG. 4A taken along line C-C of FIG. 4A.

Figure 6:
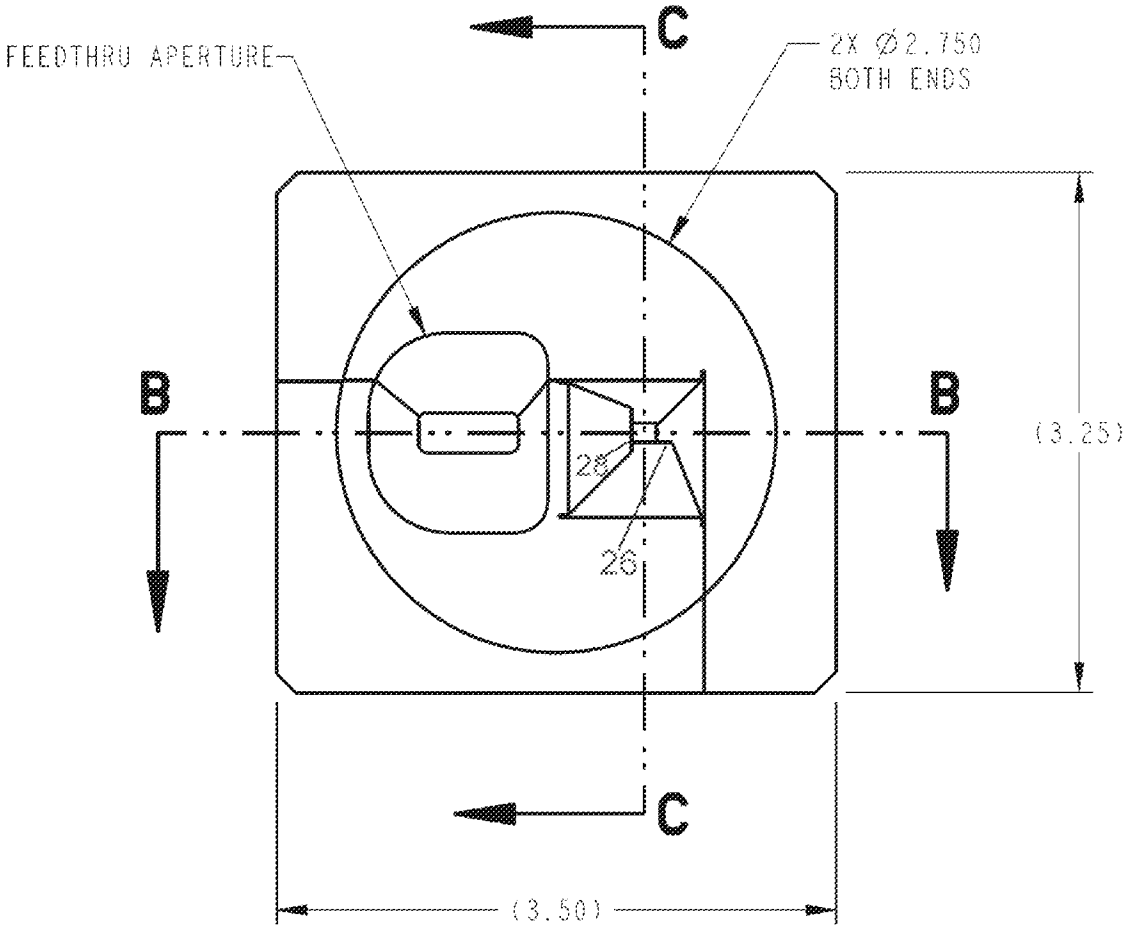
FIG. 6 is a cross section view of the monolith, in accordance with features of the present invention.

Preferably, the opposing slit edges reach an overlapping condition at some incident angle to the beam. FIG. 6 depicts this condition where a first horizontally extending edge 26 overlaps with a first vertically extending edge 28 defining the sides of the collimator 20. This prevents a rounding of corners which otherwise occur with even the most accurate of milling techniques. To effectuate this feature, the slit body is split as depicted in FIG. 3, (for example via wire electrical discharge machining, EDM) from a single piece of metal or metal composite (such as GlidCop®, mentioned supra) at two of the adjacent beam strike surfaces, whereby internal machining can be easily accomplished. The body is subsequently brazed back together at the same adjoining surfaces, ensuring a precise fit of the compound angles.

Figure 7:
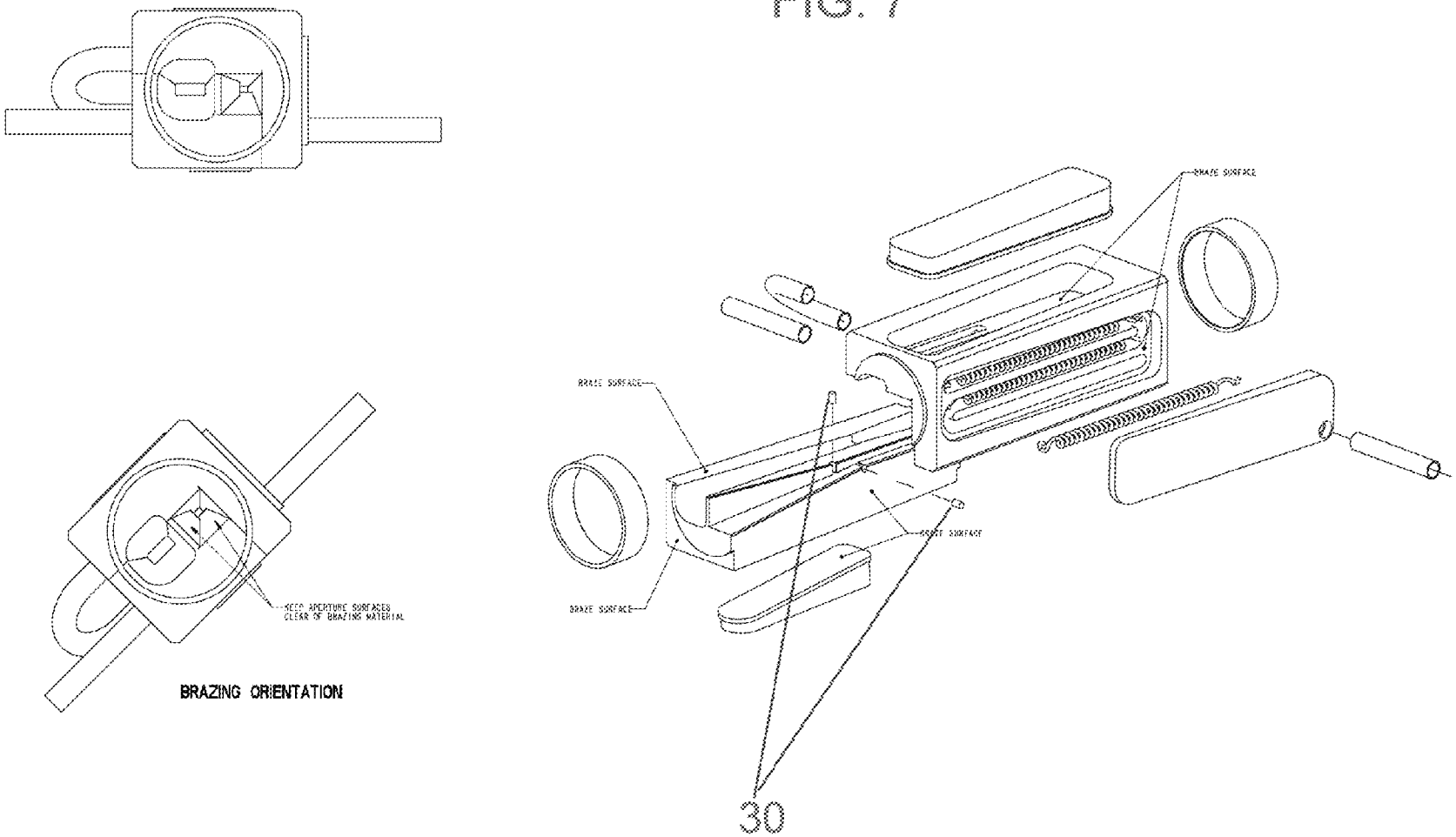
FIG. 7 is a fully exploded view of a dissembled monolith, in accordance with features of the present invention.

In instances requiring a hard beam defining edge, a suitably-sized hole (e.g. 5/16 inch) hole is drilled through the edge and slightly above tangent to the beam strike surface after the main machining was completed on the two halves. As depicted in FIG. 7, a tungsten rod 30 (or a plurality of rods) is/are inserted with brazing paste to both hold it in place and provide better thermal conductivity to the copper. The mask halves are then furnace brazed together, embedding the tungsten edges into the component. Machining of the hole for the insert often creates a very sharp edge at the trailing edge of the workpiece, and this creates a stress issue. A small chamfer, defined as a radially extending frustoconically shaped surface from the hole provides a means to alleviate this problem.

Fabrication Example

When electronic discharge is used on GlidCop® Al-15 the resulting surfaces are too rough for direct application of braze material on faying surfaces. The surfaces need to be conditioned by grinding or machining to facilitate UHV vacuum tight joints.

Test brazes with 50/50 Au Cu foil were conducted. The best results were achieved with machined surfaces and a 0.004 thick continuous foil applied to the joint. Sample brazes were sectioned and polished and revealed good fusion to the parent metal. There appears to be some non-continuous centerline porosity; however the fusion was excellent, with small amounts of gold diffusing into the GlidCop®.

The brazing was conducted in a positive pressure dry hydrogen retort. The brazing was done by applying a 50/50 AuCu paste to the tungsten to GlidCop® joint, and a 0.004 thick 50/50 Au Cu foil to the body halves. The joint faces of the slit were held at 45 degrees with the flow vertical down to avoid excess material on the beam absorbing surfaces.

The braze cycle consisted of rapid preheat to 850° C., held at preheat until the components stabilized, then a brazing spike to 990° C. with a 3 minute hold, then furnace cooling.

A second cycle was repeated to braze the stainless steel (SS) flange adapters, oxygen free copper (OFC) cooling covers and SS cooling tubes to the previously brazed GlidCop® body. Joints used 50/50 Au/Cu paste, 50/50 foil, and the same furnace cycle to accomplish water tight joints. Once the 50/50 alloy melts and fuses on GlidCop® to OFC surfaces, the re-melt temperature of the joint is high due to diffusion of gold into the base metal and copper into the braze joint. The inventors found that 50/50 gold copper joints, subject to re-braze cycles as high as 1040° C. and held for 20 minutes, will not significantly degrade.

Monolith Stage

Adjustment Detail

Beams are often collimated in the x and y directions at different points along the beam trajectory within the invented system. A salient feature of the invention is that while the beam bypass port 18 and collimator 20 have no moving parts, they are moved in unison when the monolith 12 is moved by its support stage 16.

Adjustment of the width of the beam that exits the slit/collimator system can be performed by imparting rotational motion to each collimation aperture.

Also, the width of the beam in any direction can be adjusted by rotation of the slit/collimation system about an axis perpendicular to the radiation beam and complete flexibility is provided with means imparting rotation to the entire slit/collimation system around two axes orthogonal to the z axis that intersect the z axis at a pivot point, heretofore designated as point 26 located approximately at a point three quarters of the collimator length downstream from the input. This pivot point is defined by the intersection of the pitch (P) and yaw (Y) axes, discussed supra.

Also, independent rotation and rectilinear motion of the jaws allows bringing the system to a configuration identical to that produced by rotation of the system as a whole around the pivot point 26.

To provide rotation about the vertical axis, while maintaining precise positional tolerances, an embodiment of the monolith's support stage 16 incorporates one or a plurality of bearings 17 offset by some distance to provide axial rigidity. Several suitable commercially available hub bearings satisfy this requirement with Timkin Bearing Co. (Canton, Ohio) providing a large number of different bearing designs to OEM manufacturers with an exemplary bearing being a 2000 Chevrolet Blazer front hub bearing. Generally, suitable bearings are manufactured from cast steel, and twin tapered. A flange to flange offset as much as 2 inches can be accommodated.

Generally, any commercially available precision rotation or positioning stage is suitable as a means for moving the monolith. Exemplary stages are those available from Kohzu Precision Co., Ltd., Kanagawa, Japan, and Physik Instrumente LP, Auburn, Mass.

In operation, the beam is centered on the aperture with the heat distributed across four separate surfaces so as to minimize both temperature and stress. Optionally, wire coil inserts 25 in one or more of the cooling passages enhances heat transfer. The coils are a means for providing turbulence within the cooling channel, thereby increasing thermal convection at the cooling channel walls.

It is to be understood that the above description is intended to be illustrative, and not restrictive. For example, the above-described embodiments (and/or aspects thereof) may be used in combination with each other.

In addition, many modifications may be made to adapt a particular situation or material to the teachings of the invention without departing from its scope. While the dimensions and types of materials described herein are intended to define the parameters of the invention, they are by no means limiting, but are instead exemplary embodiments. For example, a high heat load monolith is enabled with the instant specification by merely increasing the length of monoliths during fabrication, the lengths initially determined empirically. An additional benefit to increasing monolith length is that any extension of the front of the monolith would provide a larger inlet aperture, provided the angle of incidence remains constant. It should be appreciated that the invented collimator can be used to manipulate a myriad of media, including low level, high level radiation, neutrons, x-rays, and even fluids. The only constraint is that the collimator be constructed of a material having a strength to thermally and structurally withstand the forces imposed by the radiation, media or fluid during collimation events.

Many other embodiments will be apparent to those of skill in the art upon reviewing the above description. The scope of the invention should, therefore, be determined with reference to the appended claims, along with the full scope of equivalents to which such claims are entitled. In the appended claims, the terms "including" and "in which" are used as the plain-English equivalents of the terms "comprising" and "wherein." Moreover, in the following claims, the terms "first," "second," and "third," are used merely as labels, and are not intended to impose numerical requirements on their objects. Further, the limitations of the following claims are not written in means-plus-function format and are not intended to be interpreted based on 35 U.S.C. §112, sixth paragraph, unless and until such claim limitations expressly use the phrase "means for" followed by a statement of function void of further structure.

The present methods can involve any or all of the steps or conditions discussed above in various combinations, as desired. Accordingly, it will be readily apparent to the skilled artisan that in some of the disclosed methods certain steps can be deleted or additional steps performed without affecting the viability of the methods.

As will be understood by one skilled in the art, for any and all purposes, particularly in terms of providing a written description, all ranges disclosed herein also encompass any and all possible subranges and combinations of subranges thereof. Any listed range can be easily recognized as sufficiently describing and enabling the same range being broken down into at least equal halves, thirds, quarters, fifths, tenths, etc. As a non-limiting example, each range discussed herein can be readily broken down into a lower third, middle third and upper third, etc. As will also be understood by one skilled in the art all language such as "up to," "at least," "greater than," "less than," "more than" and the like include the number recited and refer to ranges which can be subsequently broken down into subranges as discussed above. In the same manner, all ratios disclosed herein also include all subratios falling within the broader ratio.

One skilled in the art will also readily recognize that where members are grouped together in a common manner, such as in a Markush group, the present invention encompasses not only the entire group listed as a whole, but each member of the group individually and all possible subgroups of the main group. Accordingly, for all purposes, the present invention encompasses not only the main group, but also the main group absent one or more of the group members. The present invention also envisages the explicit exclusion of one or more of any of the group members in the claimed invention.

The invention claimed is:

1. A method for collimating a radiation beam, wherein the beam travels along a beamline, the method comprising subjecting the beam to an aperture in a collimator, wherein the aperture is continuous throughout the length of the collimator and the collimator has no moving parts.

2. The method as recited in claim 1 wherein the aperture is integrally molded with a monolith that yaws and pitches relative to but independent of the beamline.

3. The method as recited in claim 2 wherein the dimensions of the collimator are formed when two substrates are joined to form the monolith.

4. The method as recited in claim 3 wherein the substrates are integrally molded to each other.

5. The method as recited in claim 3 wherein the substrates are reversibly joined to each other.

6. The method as recited in claim 2 wherein collimation of the beam occurs when the monolith yaws, or pitches, or yaws and pitches relative to the beamline.

7. The method as recited in claim 1 wherein the collimator defines an input surface residing in a plane that extends in a direction that is perpendicular to the beamline, and the surface is positioned relative to the beamline until a predetermined collimator configuration is achieved.

8. A system for collimating radiation beams, the system comprising:

a. a collimator body; and b. a stage for pitching or yawing or pitching and yawing the body, wherein the stage moves independently of the radiation beams.

9. The system as recited in claim 8 wherein the collimator body comprises no moving parts.

10. The system as recited in claim 8 wherein the collimator body defines a plurality of apertures adapted to receive the radiation beams.

11. The system as recited in claim 8 wherein the collimator body is comprised of a thermally conducting material selected from the group consisting of metal matrix composite alloys, tungsten, copper, copper composite, aluminum oxide ceramics, and combinations thereof.

12. The system as recited in claim 8 wherein the collimator body is fabricated from at least two substrates joined together.

13. The system as recited in claim 8 wherein the collimator body is fabricated from at least two substrates and the substrates are integrally molded to each other.

14. The system as recited in claim 8 wherein the collimator body is fabricated from at least two substrates and the substrates are reversibly joined to each other.

15. A system for collimating a medium, the system comprising:

a. a collimator body; and b. a body support surface for pitching or yawing or pitching and yawing the body, wherein the body support surface moves independently of the medium.

16. The system as recited in claim 15 wherein the collimator body is fabricated from material having a yield strength to withstand the medium it is collimating.

17. The system as recited in claim 16 wherein the medium is a neutron beam and the material is plastic.

18. The system as recited in claim 16 wherein the medium is high energy radiation and the material is comprised of a thermally conducting material selected from the group consisting of metal matrix composite alloys, tungsten, copper, copper composite, aluminum oxide ceramics, and combinations thereof.

* * * * *